US009439272B2

(12) United States Patent
Moore et al.

(10) Patent No.: US 9,439,272 B2
(45) Date of Patent: Sep. 6, 2016

(54) DISPLAY LIGHTING AND RELATED DEVICES AND METHODS

(71) Applicant: Bose Corporation, Framingham, MA (US)

(72) Inventors: Douglas C. Moore, North Grafton, MA (US); Matthew Eliot Neutra, Sherborn, MA (US); Jesse Flack, Sudbury, MA (US)

(73) Assignee: Bose Corporation, Framingham, MA (US)

( * ) Notice: Subject to any disclaimer, the term of this patent is extended or adjusted under 35 U.S.C. 154(b) by 304 days.

(21) Appl. No.: 14/047,350

(22) Filed: Oct. 7, 2013

(65) Prior Publication Data

US 2015/0097495 A1 Apr. 9, 2015

(51) Int. Cl.
*G05F 1/00* (2006.01)
*H05B 37/02* (2006.01)

(52) U.S. Cl.
CPC ..... *H05B 37/029* (2013.01)

(58) Field of Classification Search
None
See application file for complete search history.

(56) References Cited

U.S. PATENT DOCUMENTS

2006/0170376 A1* 8/2006 Piepgras et al. ..... 315/295

OTHER PUBLICATIONS

HMS Electronics: 8-Play Firmware Protocol, May 16, 2013 (7 pages).
HMS Electronics: BrightSign GPIO w/DMX512, May 16, 2013 (2 pages).
HMS Electronics: BrightSign GPIO 4×4 Interface, May 16, 2013 (2 pages).
BrightSign: Product Brocure, 2013, (16 pages).
BrightSign: Bright Author User Guide, 2013, (146 pages).

* cited by examiner

*Primary Examiner* — Cassandra Cox

(57) ABSTRACT

A method for creating a display lighting presentation is provided. The method includes providing a light sequence definition graphical user interface configured to enable entry of lighting states associated with a lighting sequence to be included in the display lighting presentation, and receiving input via the light sequence publication user interface, the input specifying lighting states to be included in the display lighting presentation.

13 Claims, 12 Drawing Sheets

DISPLAY LIGHTING AND RELATED DEVICES AND METHODS

BACKGROUND

This disclosure relates to display lighting and related devices and methods and, more particularly, to a method and system for creation of display lighting presentations.

SUMMARY

All examples and features mentioned below can be combined in any technically possible way.

In one aspect, a method for creation of a display lighting presentation is provided. The method includes providing a light sequence definition graphical user interface configured to enable entry of lighting states associated with a lighting sequence to be included in the display lighting presentation. The method further includes receiving input via the light sequence definition user interface, the input specifying lighting states to be included in the display lighting presentation.

Implementations may include one of the following features, or any combination thereof.

In some implementations the lighting states are associated with lighting actions.

In certain implementations the lighting actions include turning lights on/off, setting light intensity levels, and creating lighting effects.

In some implementations the lighting effects include causing the lights to vary repeatedly between user defined intensity levels and causing a subset of the lights to repeatedly turn on/off in a predetermined marquee pattern.

In certain implementations the light sequence definition graphical user interface includes a white board enabling both lighting actions and transitions between lighting actions to be defined.

In some implementations the transitions between lighting actions may be defined to occur after expiration of user specified amounts of time.

In certain implementations the transitions between lighting actions may be defined to occur upon occurrence of user defined external input.

In some implementations method further includes compiling the received input to create a compiled light sequence having a format configured to be loaded to and used by a lighting controller to implement the display lighting presentation.

In another aspect, a lighting sequence creation system includes a processor, and instructions stored on a computer-readable media. When executed, the instructions stored on the computer-readable media cause the processor to implement a lighting sequence definition module, the lighting sequence definition module including a light sequence definition graphical user interface configured to enable entry of lighting states associated with a lighting sequence to be specified for inclusion in a display lighting presentation. The instructions further cause the processor to compile entries received via the lighting sequence definition module into a compiled light sequence having a format configured to be loaded to and used by a lighting controller to implement the display lighting presentation.

Implementations may include one of the following features, or any combination thereof.

In some implementations the lighting states are associated with lighting actions.

In certain implementations the lighting actions include turning lights on/off, setting light intensity levels, and creating lighting effects.

In some implementations the lighting effects include causing the lights to vary repeatedly between user defined intensity levels and causing a subset of the lights to repeatedly turn on/off in a predetermined marquee pattern.

In certain implementations the light sequence definition graphical user interface includes a white board enabling both lighting actions and transitions between lighting actions to be defined.

In some implementations the transitions between lighting actions may be defined to occur after expiration of user specified amounts of time.

In certain implementations the transitions between lighting actions may be defined to occur upon occurrence of user defined external input.

In another aspect, a display lighting system includes a light driver to set intensity levels of lights connected to a plurality of lighting channels, and a lighting controller configured to receive the compiled lighting sequence and use the compiled lighting sequence to provide input to the light driver to cause the light driver to set the intensity levels of the lights connected to the plurality of lighting channels according to the compiled lighting sequence.

Implementations may include one of the following features, or any combination thereof.

In some implementations the display lighting system further includes a lighting sequence creation system, the lighting sequence creation system including a graphical user interface configured to a enable lighting sequence to be specified, and a lighting sequence compiling system configured to compile the lighting sequence specified via the graphical user interface to create the compiled lighting sequence and forward the compiled lighting sequence to the lighting controller.

DETAILED DESCRIPTION

This disclosure is based, at least in part, on the realization that it can be beneficial to provide an easier way to create and implement display lighting presentations. In one embodiment a light sequence definition graphical user interface is provided which is configured to enable entry of lighting states associated with a lighting sequence to be included in the display lighting presentation. Input received via the light sequence graphical user interface, including input specifying lighting states to be included in the display lighting presentation, is compiled and provided to a lighting controller to enable the lighting controller to execute the defined display lighting presentation.

System Overview

Display lighting systems are used to control lights such as indirect ambient light sources and direct light sources. Display lighting systems of this nature may be used in connection with audio/visual display systems. In this manner, external light effects can be synchronized with the audio/visual displays being shown on the audio/visual display systems to create an enhanced multi-media presentation. Lighting control systems of this nature may be utilized in a retail environment, to highlight items for sale, as well as in other contexts including home lighting, outdoor lighting, automotive lighting, or anywhere lighting is used and it is desirable to control how the lighting is activated.

Figure 1:
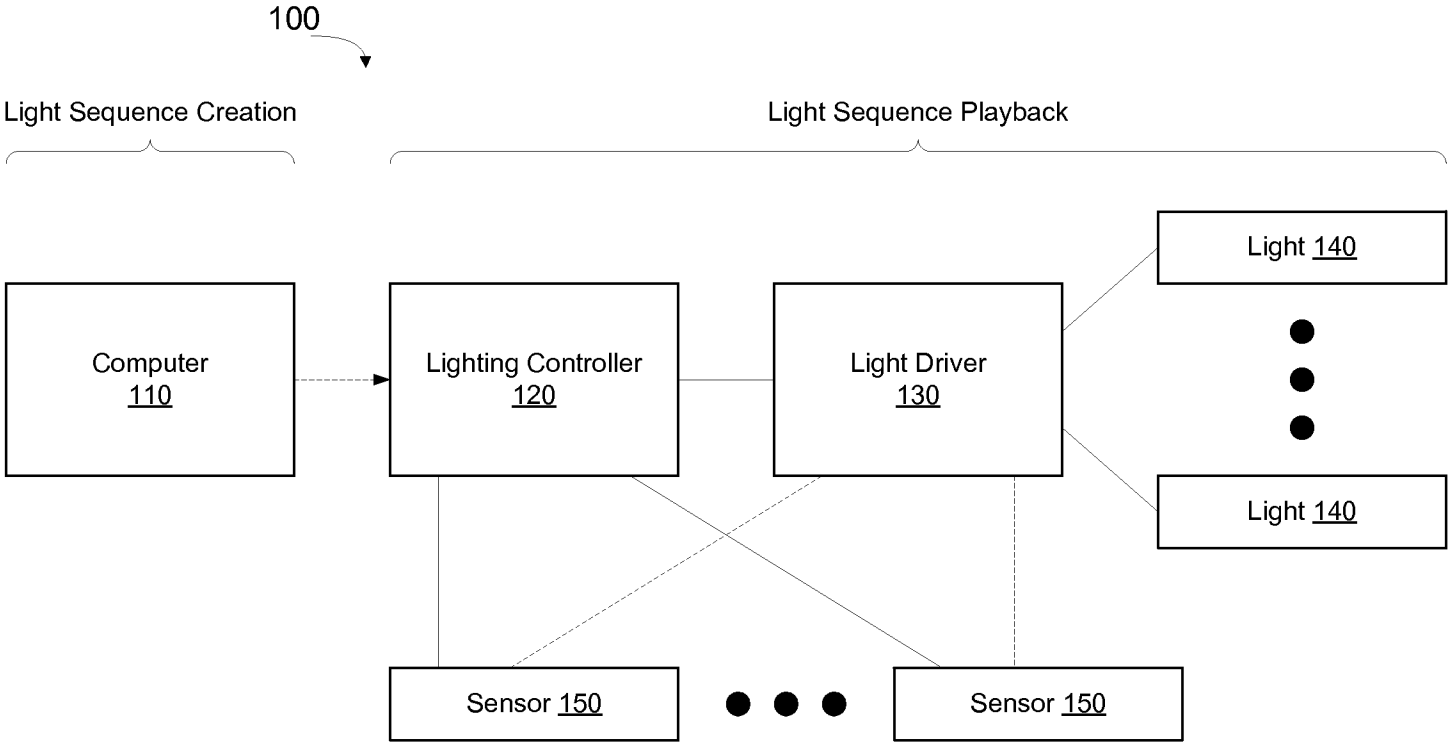
FIG. 1 is a block diagram of an example display lighting system.

FIG. 1 shows an example display lighting system 100. In the example shown in FIG. 1, a light sequence creation device 110 is used to create a light sequence definition. The light sequence definition is compiled and forwarded to a lighting controller 120. The lighting controller 120 uses the light sequence definition to control a light driver 130 which adjusts lights 140 as specified by the light sequence definition. Input from sensors 150 may be received by lighting controller to control progression through the light sequence definition. Input from the sensors 150 may also be directed to the light controller 120 as shown using solid lines in FIG. 1, or may be input to the light controller 120 via light driver 130 as shown using dashed lines in FIG. 1.

Figure 2:
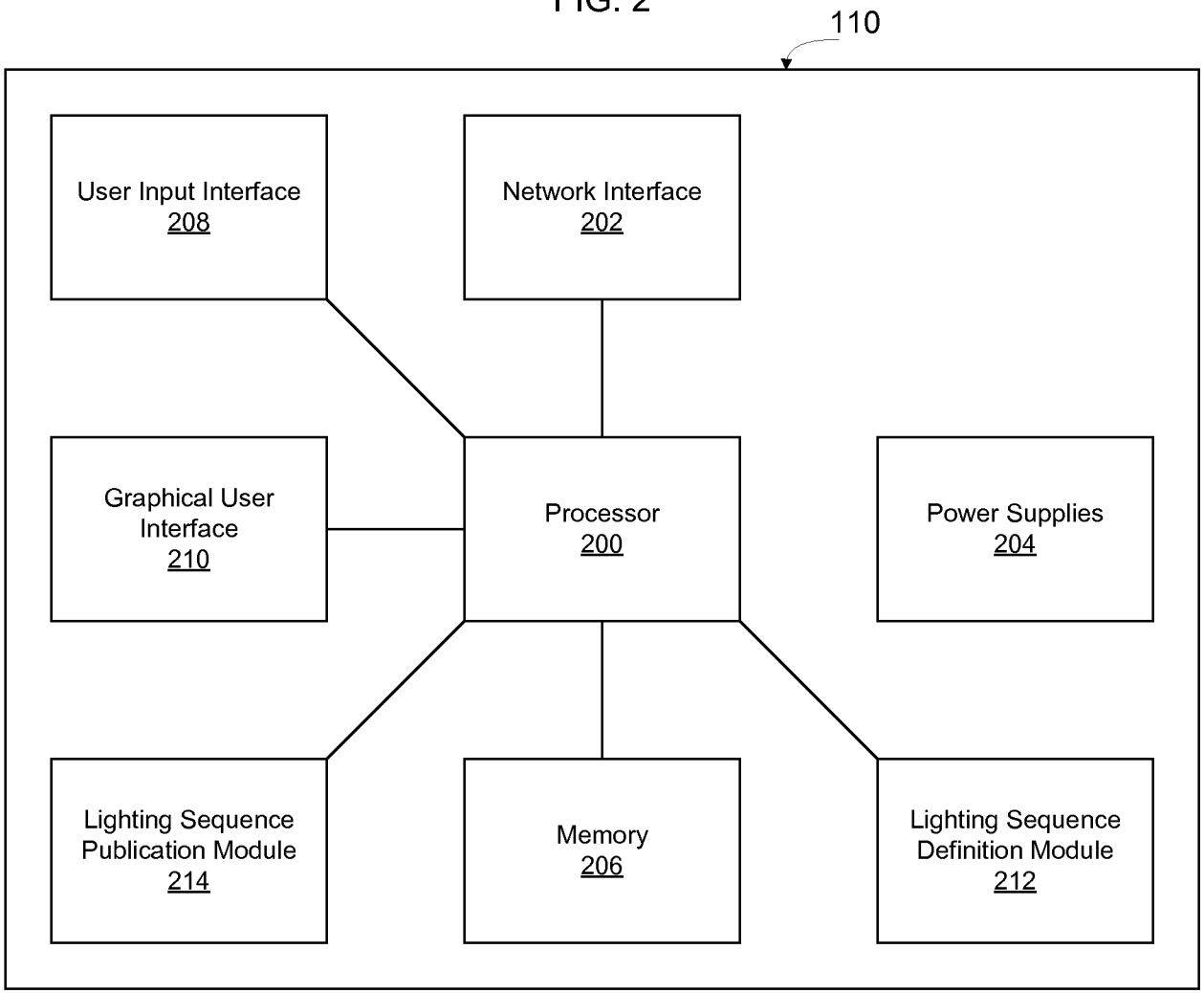
FIG. 2 is a block diagram of an example component of the display lighting system of FIG. 1 that may be used to create a light sequence.

FIG. 2 is a functional block diagram of an example light sequence creation device that may be used in connection with creating a light sequence. In one embodiment the light sequence creation device may be implemented as a special purpose or general purpose computer. As shown in FIG. 2, the light sequence creation device 110 includes a processor 200, a network interface 202, and power supplies 204 for powering the various components of the light sequence creation device. The light sequence creation device also includes memory 206, and user input interface 208. Each of the processor 200, network interface 202, power supplies 204, memory 206, and user input interface 208, are interconnected using various buses, and several of the components may be mounted on a common motherboard or in other manners as appropriate.

The network interface 202 provides for communication between the lighting system creation device 110 and the lighting controller 120 via one or more communications protocols. The network interface 202 provides network access to enable the lighting system creation device 110 to communicate on network. The network interface may be implemented as a wireless network interface to enable the lighting system creation device to communicate on a wireless network implemented using a communication protocol such as such as IEEE 802.11 b/g. Likewise the network interface may be implemented as a wired network interface to enable the lighting system creation device to communicate on a wired network implemented using a communication protocol such as Ethernet.

The network interface may also be implemented to include one or more USB ports to enable the device to communicate with other devices via USB. The network interface 202 can also include a Bluetooth Low Energy (BTLE) system-on-chip for Bluetooth low energy applications (e.g., for wireless communication with a Bluetooth enabled controller).

Memory 206 stores information within the lighting system creation device 110. In this regard, the memory 206 may store information related to light sequences created by the light sequence creation device. Specifically, the memory 206 may contain one or more application programs, such as lighting sequence definition module 212 and lighting sequence publication module 214. The light sequence definition module, when loaded into the processor 200, enables the lighting sequence creation device to provide a graphical user interface 210 configured to be used to create light sequence definitions. The light sequences defined in the light sequence definition module and provided to the light sequence publication module which is configured to compile the light sequence definitions into a format to be loaded to the lighting controller. The compiled light sequences are interpreted by the lighting controller 120 to implement the lighting sequence in the display lighting system. Where the light sequence is to be implemented as part of a multi-media audio/video presentation, the lighting controller 120 causes execution of the compiled lighting sequence in synchronization with implementation of the audio/video presentation.

The memory 206 may include, for example, flash memory and/or non-volatile random access memory (NVRAM). In some implementations, instructions (e.g., software) are stored in an information carrier. The instructions, when executed by one or more processing devices (e.g., the processor 200), perform one or more processes. The instructions can also be stored by one or more storage devices, such as one or more computer- or machine-readable mediums (for example, the memory 206, or memory on the processor). The instructions may include instructions for performing the processes described herein in connection with lighting sequence definition module 212 and lighting sequence publication module 214.

The lighting sequence creation device 110 may be implemented as a device capable of running applications including lighting sequence definition module 212 and lighting sequence publication module 214. Example devices of this nature include desktop computers, laptop computers, and mobile devices such as smart phones and tablets. Graphical user interface 210 is configured in connection with execution of the lighting sequence definition module to enable the user to interact with the lighting sequence definition module via user input interface 208 and specify lighting actions to be included in the light sequence. Once a light sequence has been defined, the light sequence publication module 214 compiles the light sequence into a form for execution by lighting controller 120.

Figure 3:
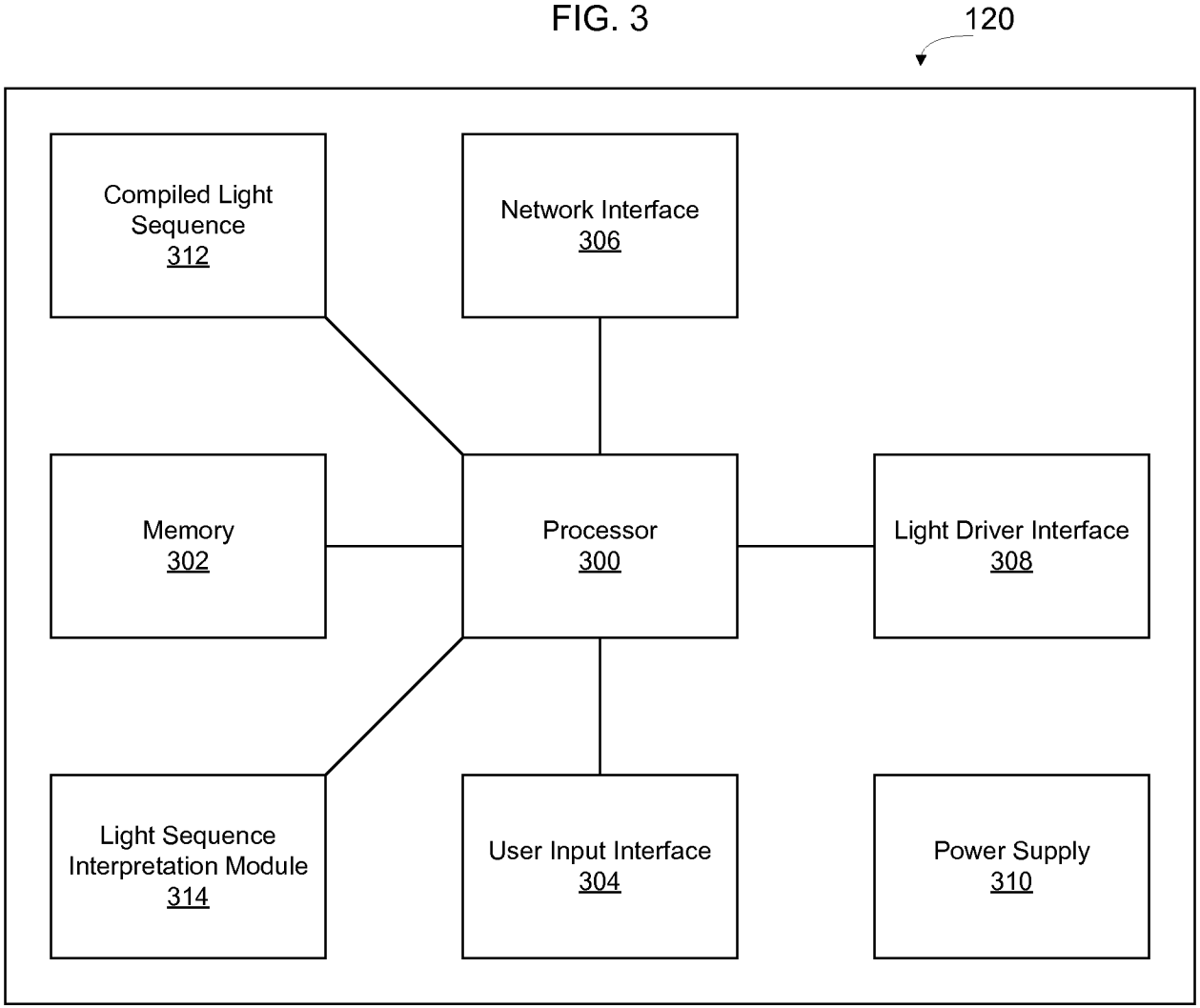
FIG. 3 is a block diagram of an example lighting controller of the display lighting system of FIG. 1.

FIG. 3 is a functional block diagram of an example lighting controller 120. As shown in FIG. 3, in one embodiment the lighting controller 120 includes a processor 300 a memory 302, a user input interface 304, a network interface 306, and a light driver interface 308. A power supply 310 is provided for powering the various components of the lighting controller. Each of the processor 300, memory 302, user input interface 304, network interface 306, and light driver interface 308, are interconnected using various buses, and several of the components may be mounted on a common motherboard or in other manners as appropriate.

The network interface 306 provides for communication between the lighting system creation device 110 and the lighting controller 120 via one or more communications protocols. The network interface 306 provides network access to enable the light controller 120 to communicate on network. The network interface may be implemented as a wireless network interface to enable the light controller 120 to communicate on a wireless network implemented using a communication protocol such as such as IEEE 802.11 b/g. Likewise the network interface may be implemented as a wired network interface to enable the light controller 120 to communicate on a wired network implemented using a communication protocol such as Ethernet.

The light driver interface 308 provides for communication between the lighting controller 120 and the light driver via one or more communications protocols. In one embodiment, the light driver interface 308 may be implemented as a USB interface to enable one or more light drivers to be connected to the lighting controller using one of the USB protocols. Light driver interface may also be used to receive input from sensors 150.

Memory 302 stores information within the lighting controller 120. In this regard, the memory 302 may store the compiled light sequence 312 created by the light sequence creation device 110. Additionally, the memory 302 may contain one or more application programs, such as a lighting sequence interpretation module 314, configured to enable the lighting controller to interpret the lighting actions specified in the compiled lighting sequence 312. These modules, when loaded into the processor 300, enable the lighting controller to be used to implement the compiled light sequence created by the light sequence creation device 110.

The memory 302 may include, for example, flash memory and/or non-volatile random access memory (NVRAM). In some implementations, instructions (e.g., software) are stored in an information carrier. The instructions, when executed by one or more processing devices (e.g., the processor 300), perform one or more processes. The instructions can also be stored by one or more storage devices, such as one or more computer- or machine-readable mediums (for example, the memory 302, or memory on the processor). The instructions may include instructions for performing the processes described herein to enable the lighting controller receive input from sensors 150 and to output instructions to the light driver to cause the light driver to activate/deactivate or otherwise control lights 140.

The lighting controller uses the compiled light sequence 312 and input from sensors 150 to execute the compiled light sequence 312. The compiled light sequence includes a series of lighting actions the transition between which may be statically defined in the lighting sequence or the transition between which may be dynamically affected by input from the sensors 150. An example statically defined transition between lighting actions may be to activate a first light for a first period of time, e.g. 2 seconds, and then to deactivate the first light while activating a second light. As is clear from this example, statically defined transitions occur based on time or other variables which are inherently measurable and which are specified wholly within the light sequence itself. An example dynamically defined transition between lighting actions may be to activate a first light when a person presses a particular button. The sensor 150 obtains input related to the button press and, in this example, conveys the sensed input to the lighting controller to cause the lighting controller to execute a transition between lighting actions based on the received input. As is clear from this example, dynamically defined transitions occur based at least in part on input received from one or more of the sensors and not wholly based on time or other measurable quantities specified by the light sequence itself.

Figure 4:
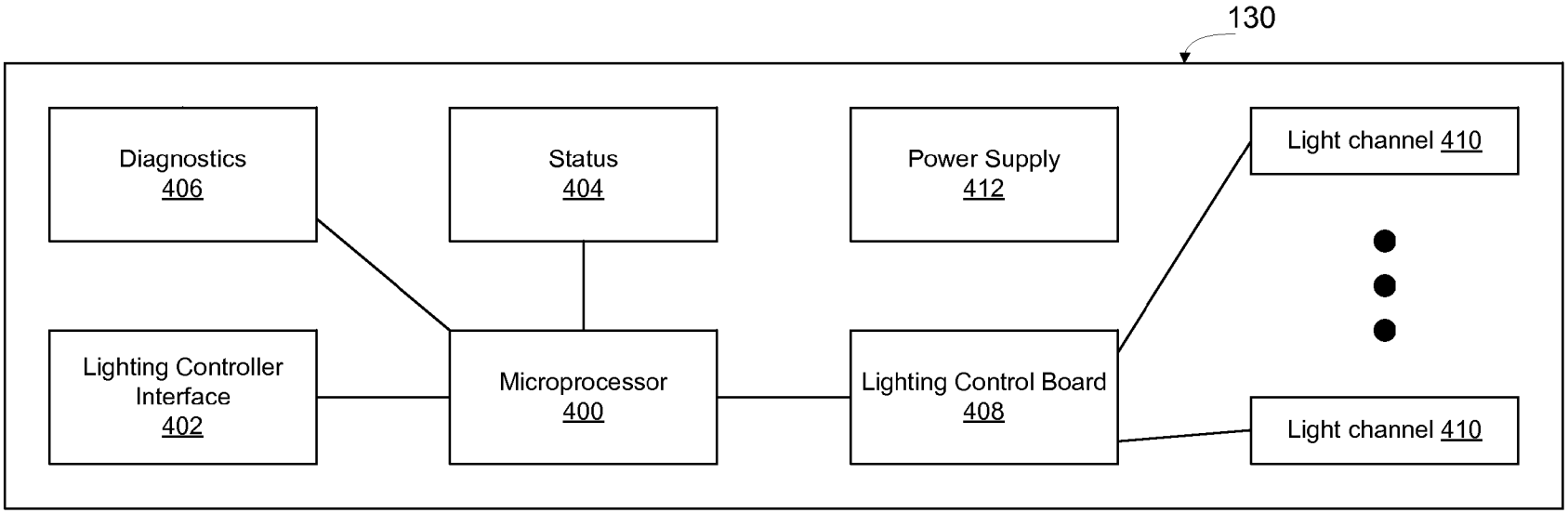
FIG. 4 is a block diagram of an example light driver of the display lighting system of FIG. 1.

FIG. 4 is a functional block diagram of an example light driver 130. As shown in FIG. 3, in one embodiment the light driver 130 includes a microprocessor 400, alighting controller interface 402, status indicators 404, a diagnostic interface 406, lighting control board 408 and a plurality of light channels 410. A power supply 412 is provided for powering the various components of the light driver 130. Each of the microprocessor 400, interface 402, status indicators 404, diagnostic interface 406, lighting control board 408 and plurality of light channels 410 are interconnected using various buses, and several of the components may be mounted on a common motherboard or in other manners as appropriate.

Microprocessor receives input from lighting controller 120 regarding lighting state via light controller interface 402, and implements the light state via lighting control board 408. The light channels 410 are connectors that enable lights to be connected to the light driver 130. The particular light channels 410 utilized may be configured to support particular types of lights, such as LED lights or other types of external light sources. The lighting control board provides power at a voltage/amperage level required by the lights intended to be connected to the light channel 410. For example, where LED lights are intended to be connected to the light channels 410, the LED lighting control board 408 may be configured to provide 12 volt power at up to one ampere on each of the light channels. Other voltage levels and power levels may likewise be implemented.

Light Sequence Creation Software

Figure 5:
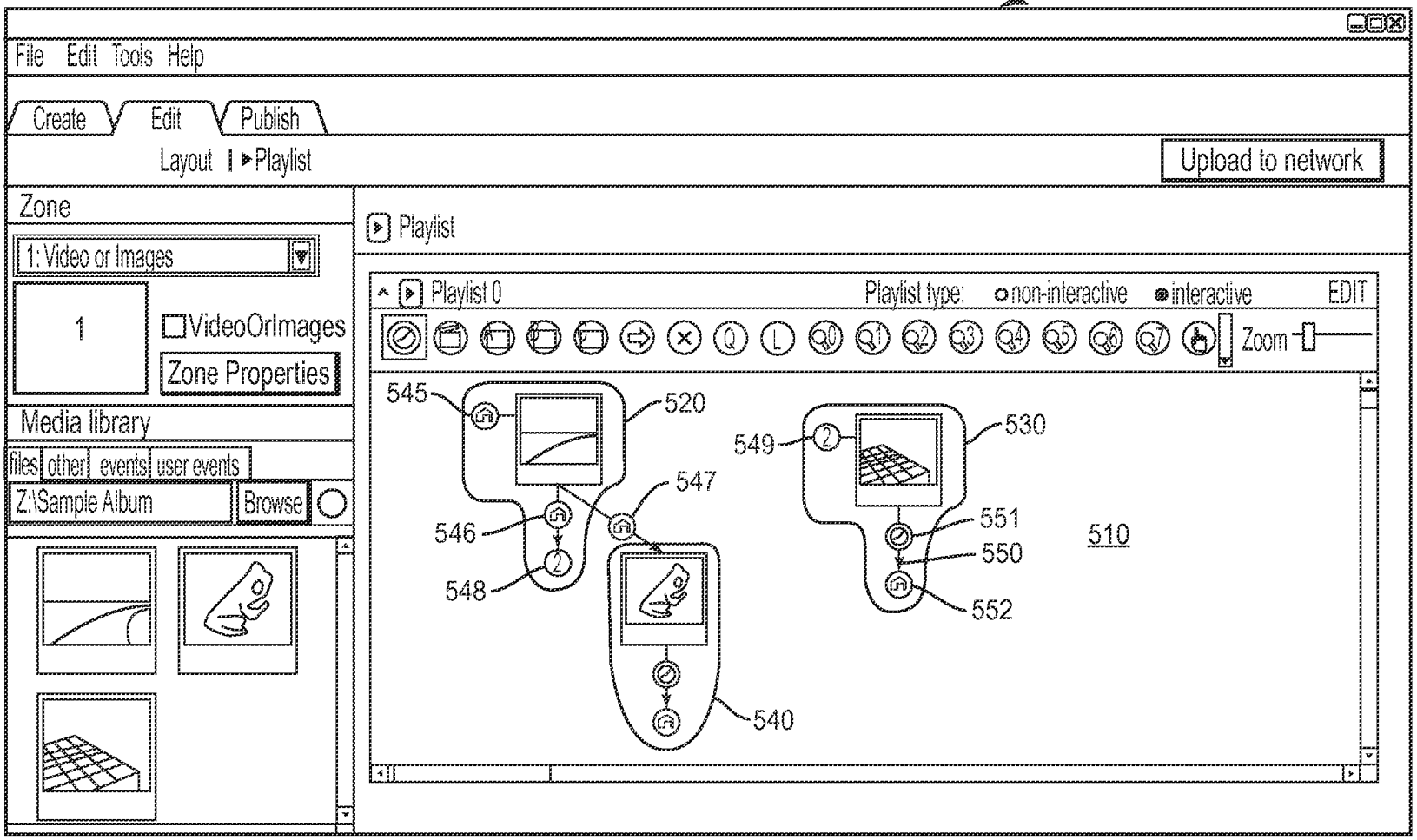
FIGS. 5-12 are user interface diagrams showing an example user interface that may be utilized in connection with creation of light sequences to be implemented by the display lighting system of FIG. 1.

FIG. 5 shows an example graphical user interface 210 which may be implemented in connection with lighting sequence definition module 212 and used to create light sequences according to an embodiment. As shown in FIG. 5, the example light sequence definition graphical user interface includes a white board 510 on which lighting actions 520 and the transition between lighting actions may be defined.

FIG. 5 shows an example lighting sequence in which three light states 520, 530 540 are defined. Other lighting sequences may likewise be defined in which additional or fewer states are specified. Each lighting state is associated with a particular lighting action, i.e. turning on/off or setting the intensity of one or more of lights 140. Light states specified in the light sequence are compiled to a compiled light sequence which is loaded to lighting controller 120 and used by lighting controller 120 to output instructions to light driver 130. The light driver 130 uses the instructions to activate lighting channels 410 which thus cause the correct light effect at lights 140.

In this embodiment, the light sequence creation device 110 is used to create a light sequence which is compiled and downloaded to the lighting controller 120. By downloading the lighting sequence to the lighting controller, the light sequence creation device is not required to be connected to the lighting controller while the sequence is being run. For example, when the lighting sequence creation device is a laptop computer, the laptop computer can be used to create the lighting sequence which is then downloaded to the lighting controller. However, the laptop computer is not required to be connected to the lighting controller while the sequence is being run. Rather, the lighting controller can simply run the lighting sequence autonomously so that the laptop computer is not required to be present while the lighting sequence executes.

The lighting sequence in the illustrated example has a first state 520, a second state 530, and a third state 540. In the first state, represented by home icon 545, a first light action is defined. The first light action may include turning on one or more of the lights 140, turning off one or more lights, causing one or more lights to blink, strobe, marquee, or causing one or more other lighting effects.

In the example shown in FIG. 5, there are two transitions 546, 547, from the first state 520 to state 530 and state 540, respectively. Both of the transitions 546, 547 are dynamically defined transitions which, in this example, are specified to occur based at least in part on input received from one or more of the sensors and not wholly based on time or other measurable quantities specified by the light sequence itself. Specifically, in this example, if one of the sensors 150 detects a first user input, the lighting sequence specifies transition 546 in which the state transitions to the state specified second state 530. This transition is graphically illustrated on the whiteboard by showing a sensor icon in the transition line associated with transition 546. A state identifier 548 at the end of the transition line 546 identifies the state associated with the transition 546.

State 530 has an associated lighting action. Upon transition from state 520 to state 530, the light controller will cause the light driver 130 to change the manner in which the light channels 410 are energized to implement the new lighting action. Number 549 identifies the state 530 and matches state identifier 548. This indicates that transition 546 will cause a transition to state 530 without requiring a line to be drawn on whiteboard 510 connecting the two states. This enables logical coupling of the states without requiring an attendant visual direct link between the states to enable the user to organize state transitions in a more visually simple manner.

In the illustrated example, state 530 will transition back to home state 520 upon expiration of a set period of time. Transition arrow 550 includes a timer icon 551 indicating that the state 530 will exist for a fixed period of time and then automatically transition to the state identified by state indicator 552 at the end of transition arrow 550. Although in this example state 530 is configured to transition back to home state 520 upon expiration of a fixed period of time, a dynamic transition dependent on external input could likewise have been defined as a trigger mechanism to cause transition away from state 530.

As noted above, the example lighting sequence includes two transitions from state 520. Upon receipt of external input, transition 547 causes the lighting sequence to transition to state 540, in which the light controller will cause the light driver 130 to change the manner in which the light channels 410 are energized to implement the new lighting action. Due to the relative proximity of state 540 and 520 on the whiteboard 510, this transition is indicated by showing a transition arrow drawn directly between states 520 and 540 rather than using a state identifier at the end of transition arrows.

It is possible to define any number of states, as well as transitions between the states, to enable a lighting sequence to be created that will operate to adjust lighting under the control of the display lighting system. States may be chained together such that dynamic states transition to other dynamic states upon receipt of appropriate input. Likewise states may be chained together such that static states transition to other static states after a period of time or upon occurrence of another statically defined event not dependent on external input.

FIGS. 6-12 show example screens that may be used in an example graphical user interface 210 to specify light actions for a selected state. In this example, when one of the icons representing the state is selected, a media properties command window 600 is opened. The media properties command window has a command region 610 which enables the user to specify the type of media to be associated with the selected state. In FIGS. 6-12, aspects of how lighting may be specified via the media properties command window are highlighted. Other media such as audio and video may likewise be specified by selecting an appropriate media in the commands drop-down menu 630.

When the user elects to use the media properties command window 600 to specify lighting aspects for a given selected state, the user specifies in command region that the entry 615 should be used to "set panel output". This signifies to the light sequence definition module 212 that the entry 615 is associated with lighting actions.

Media properties command window 600 also includes a command parameters region 620 which enables the user to set parameters associated with the selected command. Depending on the selected command, different selections of customizable parameters selectable via drop down menus 640 will appear in the command parameters region 620 to enable the user to specify appropriate parameters for the selected command. Since different commands may require the user to select different types of parameters, the command parameters field does not always include the same set of customizable parameters selectors 640.

Figure 6:
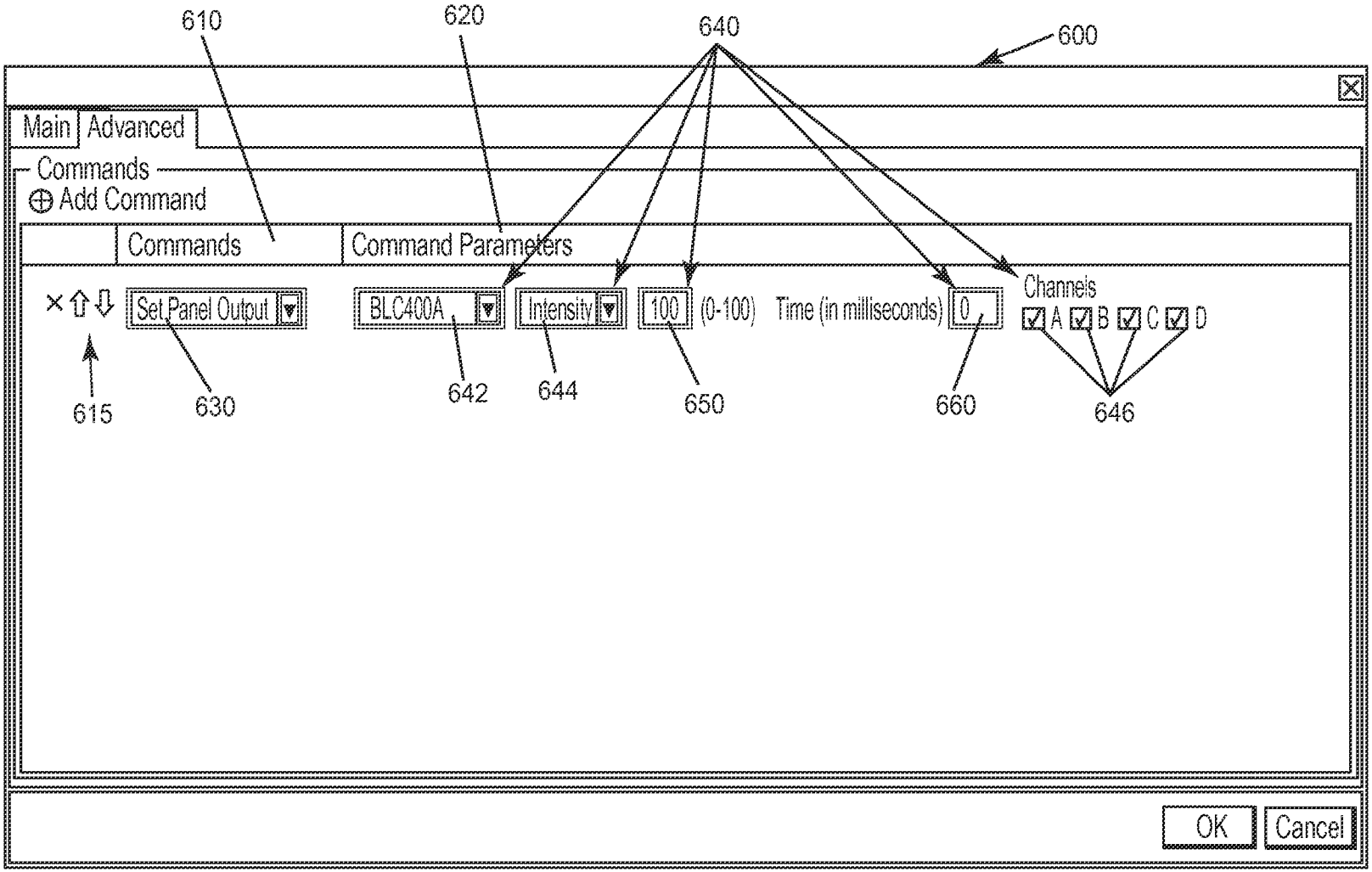

FIG. 6 shows an example in which the command selected by the user is "Set Panel Output". This command enables the user to specify how lights connected to the light channels should be turned on/off or otherwise define light actions to be implemented by the display lighting system. Other commands enable audio and video functions to be specified which also may be specified using the same graphical user interface. Thus, the same graphical user interface enables light actions to be specified to occur in connection with presentation of audio/visual information to enable an integrated audio/visual/light presentation to be created.

In the example shown in FIG. 6, the customizable parameters selectors available for this command include a lighting controller selector 642, an action selector 644, and a channel specification selector 646. Other commands may be made available in other implementations.

The channel specification selector 646 enables one or more light channels to be selected to be used to create the specified lighting effect. In the illustrated example, there are four channels labeled A, B, C, and D. Check boxes are provided enabling the user to select (check) a channel that is to be affected by the entry.

The action selector 644 enables an effect to be specified for the entry. Example effects include setting the light intensity (FIG. 6), causing the lights to blink (FIGS. 7 and 8), causing the lights to breathe (FIG. 9), causing the lights to strobe (FIG. 10), and causing the lights to marquee (FIG. 11). Depending on the selected action, different fields such as fields 650, 660 are provided in the command parameters region to enable specific parameters for the selected lighting effect to be specified.

In FIG. 6 the action selected in action selector drop-down menu 644 is "Intensity". This action enables the user to set the brightness level of one or more of the selected light channels. The same intensity is set to each of the selected light channels. Where different intensities are desired for different lights, separate entries should be used. As shown in FIG. 6, the user can set the intensity level by specifying a number from 1 to 100 in intensity level box 650. The user may also specify via time box 660 the amount of time, in milliseconds, that the light should take to transition to the specified intensity level. This option enables the user to specify the duration of time it takes to transition between specified intensity levels so that the user can specify a desired transition ranging from an abrupt transition (0 ms) to a long slow transition (5000 ms).

Figure 7:
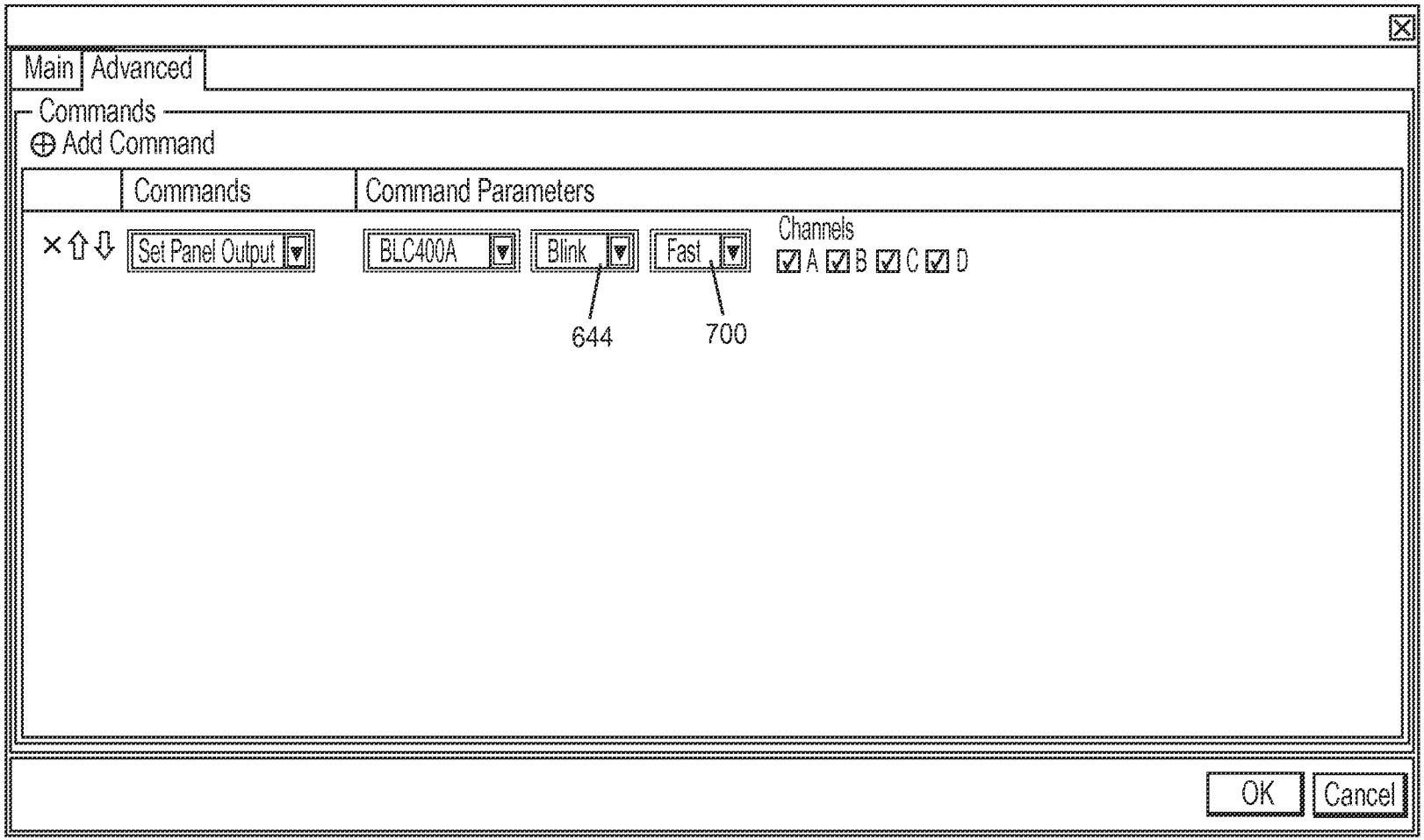
Figure 8:
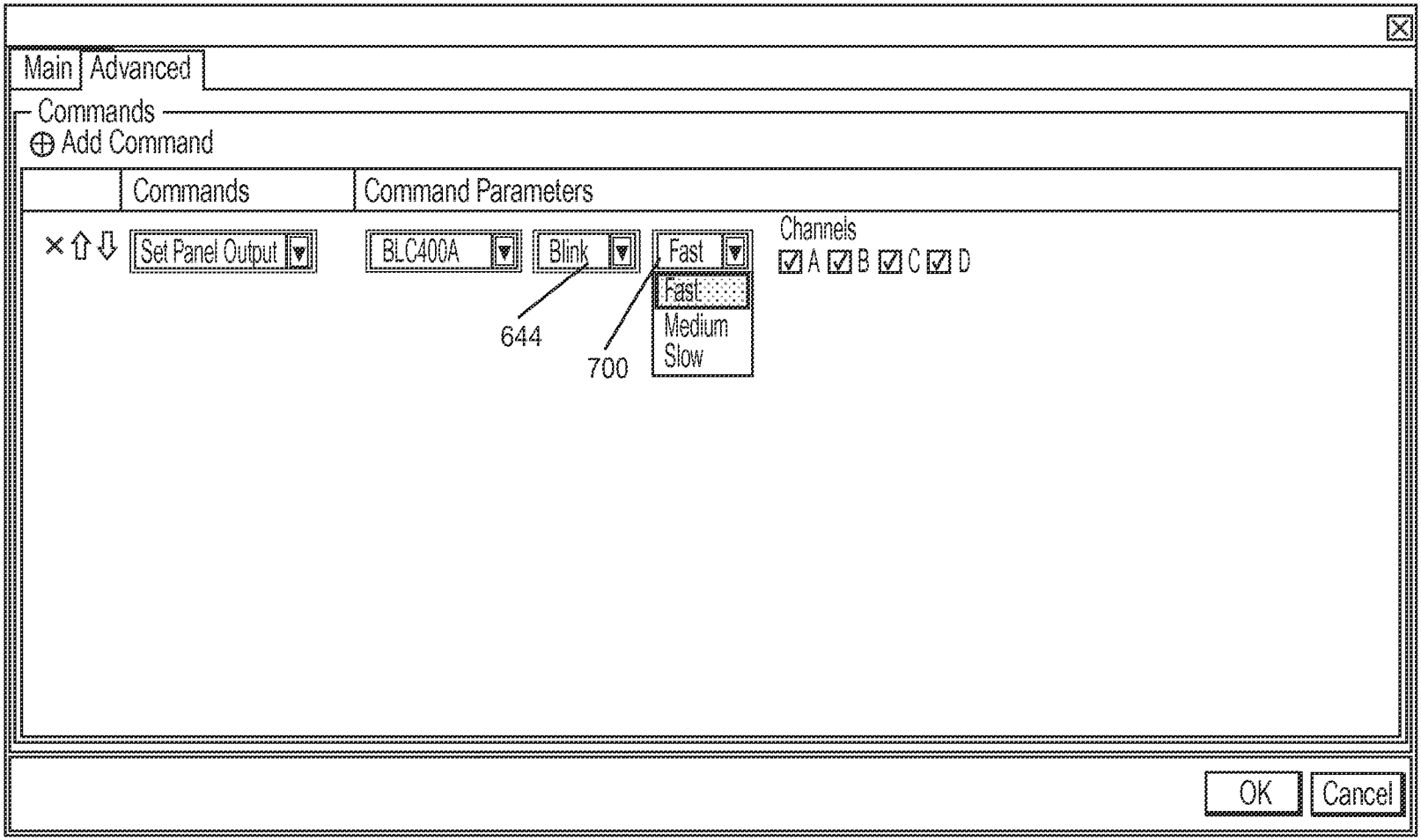

FIGS. 7-8 shows another example in which the action selected in action selector drop-down menu 644 is "Blink". This option enables the user to select one or more channels of lights to repeatedly turn on and off at a selected rate. A rate selector drop-down 700 (see FIG. 8) is used in this example to enable the user to select a rate at which the lights will blink. As shown in FIG. 8, the rate selector drop-down menu 700 enables the user to select from Fast, Medium, and Slow blink rate options. Other forms of rate selectors may be utilized instead, for example to enable the user to specify an amount of time the lights are on and an amount of time the lights are off to create a customized blinking pattern.

Figure 9:
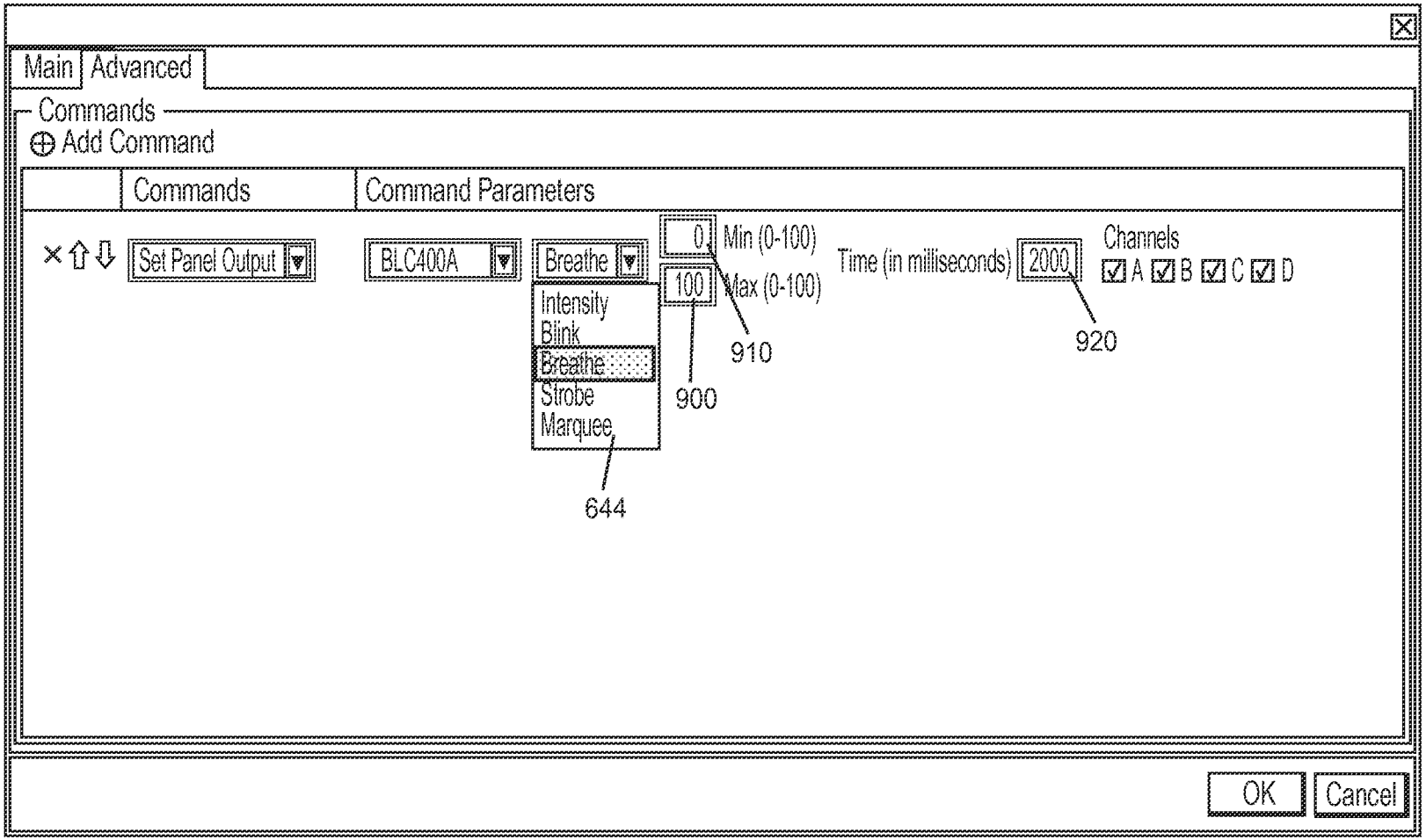

FIG. 9 shows another example in which the action selected in action selector drop-down menu 644 is "Breathe". This option enables the user to select one or more channels of lights to repeatedly vary between a specified minimum intensity level 900 and maximum intensity level 910. The amount of time it takes to gradually increase from the minimum to maximum intensity levels is specified in box 920. The amount of time specified in box 920 will likewise be used to specify the transition from maximum to minimum intensity levels.

Figure 10:
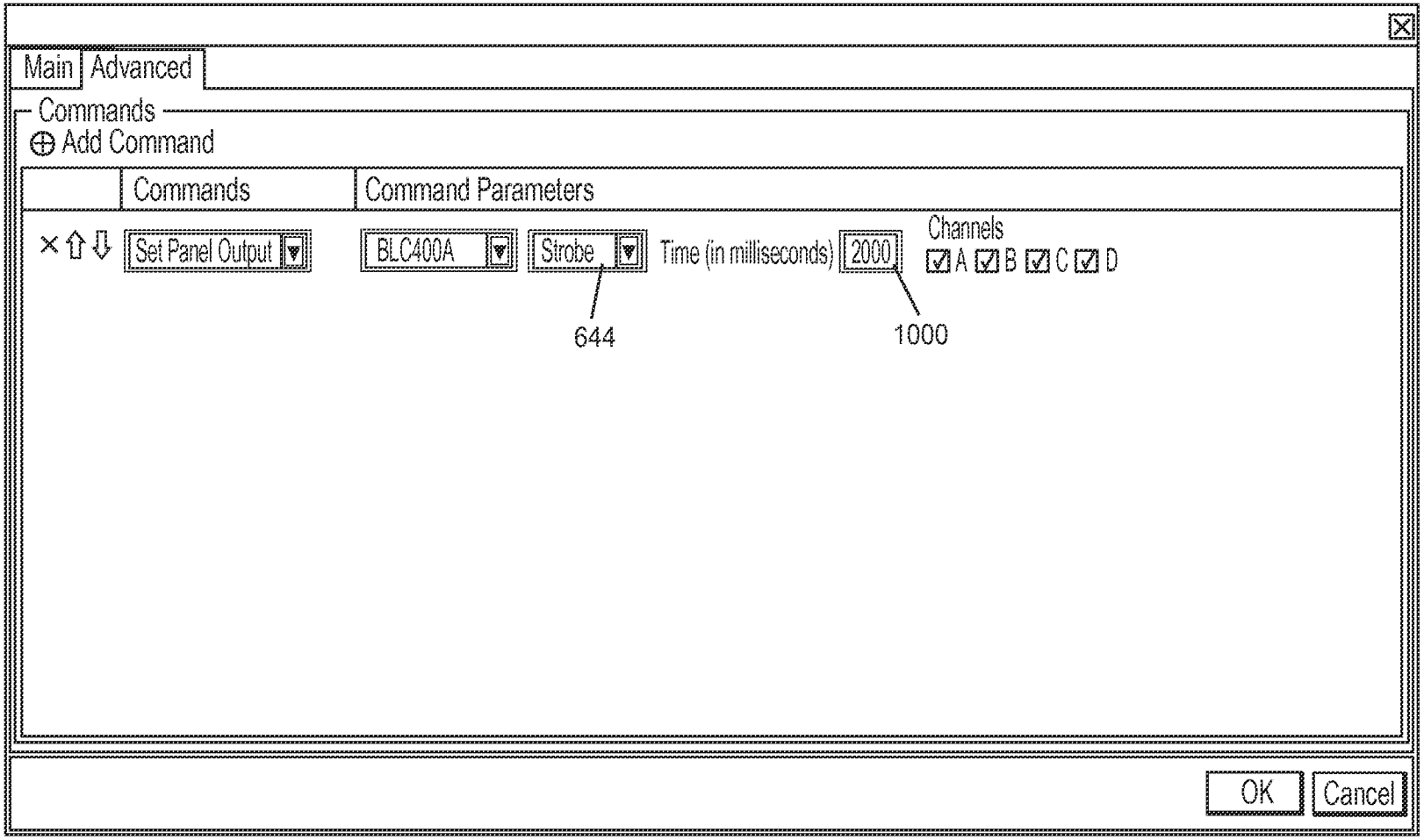
Figure 11:
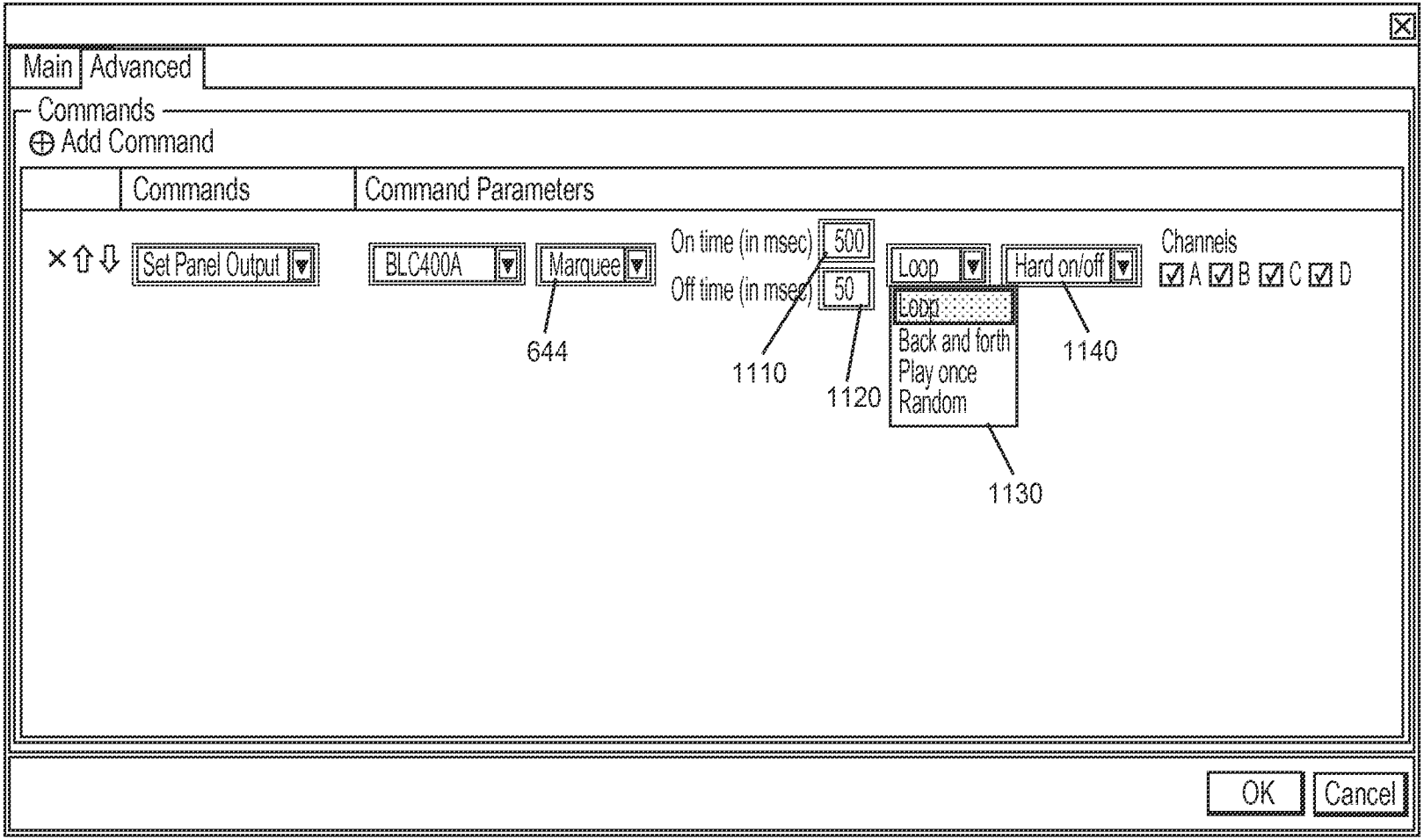

FIG. 10 shows another example in which the action selected in action selector drop-down menu 644 is "Strobe". The strobe action is similar to blink, except that the user is provided with the ability to specify how long the lights will be turned on. Specifically, as shown in FIG. 10, when the strobe action is selected, a time box 1000 is provide in which the user is able to specify the length of the strobe. The time specified in box 1000 may include only the ON portion of the strobe cycle, or may include the entire strobe cycle (both ON and OFF portions of the strobe cycle).

FIG. 11 shows another example in which the action selected in action selector drop-down menu 644 is "Marquee". A marquee effect is one in which lights are turned on or off in a particular sequence. In the example shown in FIG. 11, the user is able to specify the amount of time that an activated light will be turned on 1110 as well as the amount of time that an activated light will be turned off 1120. The user is also able to specify the marquee effect 1130 which, in this example, includes causing lights to loop, move back/forth, play once, or be turned on in a random fashion. The user is also able to specify the manner in which the lights are turned on/off 1140, such as by specifying that the lights are turned on/off in a hard manner or specifying that the lights are turned on/off more gradually to cause fading on/off to occur.

Figure 12:
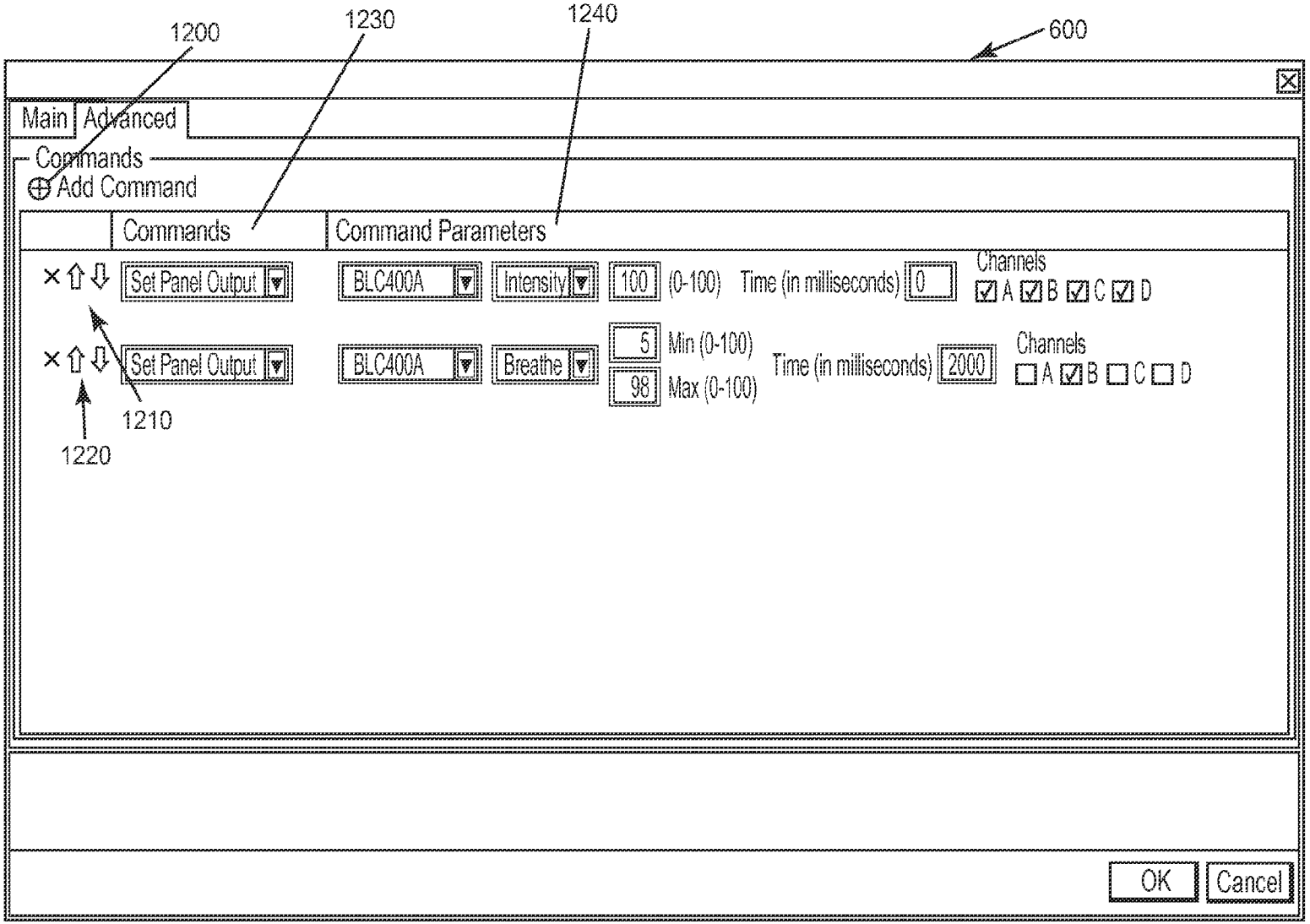

FIG. 12 shows another example in which multiple actions are selected for different sets of light channels for a single action state 540. In this example, two command entries have been added to a given one of the states 520, 530, 540, specifying how light actions associated with that selected state should be implemented. More than two command entries may be associated with a given state 520, 530, 540. Likewise, although not shown, audio and video actions may be selected and defined for a given state 520, 530, 540.

As shown in FIG. 12, the user interface has an add command button 1200 that the user can select to add one or more actions via the media properties command window 600. The command button 1200 enables the user to add command entries specifying light actions, audio actions, and video actions, which are to be associated with a given state 520, 530, 540. Each of the command entries 1210, 1220 enables the user to select a command and specify the command properties 1240. In the illustrated example, the commands are both related to how lights should be configured, so the command selected for both of the channel entries is "set panel output". In one embodiment audio and video aspects may likewise be associated with state, and hence may also be specified via the media properties command window 600.

Each of the channel entries enables the user to specify separate actions that should apply to different sets of lighting channels. Specifically, as shown in FIG. 12, channel entry 1210 has been set to apply to all of channels A, B, C, and D, while channel entry 1220 has been set to apply only to channel B. Likewise, since the channel entries are independent, each channel entry may specify a separate action selector. In the illustrated example the action selector for command entry 1210 is "intensity" which allows the user to specify the light level for the lights associated with the selected channel. Likewise the action selector for command entry 1220 is "breathe" which allows the user to specify how the light level for the selected channel (channel B in this example) should vary in intensity over time.

Implementations of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. In addition, the instructions may be implemented in a high-level procedural and/or object-oriented programming language, and/or in assembly/machine language. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other implementations are within the scope of the following claims.

What is claimed is:

1. A method for creation of a display lighting presentation, the method comprising:

providing a light sequence definition graphical user interface configured to enable entry of lighting states associated with a lighting sequence to be included in the display lighting presentation; and receiving input via the light sequence definition user interface, the input specifying lighting states to be included in the display lighting presentation, wherein the lighting states are associated with lighting actions, wherein the lighting actions include turning lights on/off, setting light intensity levels, and creating lighting effects, and wherein the lighting effects include causing the lights to vary repeatedly between user defined intensity levels and causing a subset of the lights to repeatedly turn on/off in a predetermined marquee pattern.

2. The method of claim 1, wherein the light sequence definition graphical user interface includes a white board enabling both lighting actions and transitions between lighting actions to be defined.

3. The method of claim 2, wherein the transitions between lighting actions are defined to occur after expiration of user specified amounts of time.

4. The method of claim 2, wherein the transitions between lighting actions are defined to occur upon occurrence of user defined external input.

5. The method of claim 1, further comprising compiling the received input to create a compiled light sequence having a format configured to be loaded to and used by a lighting controller to implement the display lighting presentation.

6. A lighting sequence creation system, comprising:

a processor; and instructions stored on a computer-readable media that, when executed, cause the processor to:

implement a lighting sequence definition module, the lighting sequence definition module including a light sequence definition graphical user interface configured to enable entry of lighting states associated with a lighting sequence to be specified for inclusion in a display lighting presentation; and compile entries received via the lighting sequence definition module into a compiled light sequence having a format configured to be loaded to and used by a lighting controller to implement the display lighting presentation, wherein the lighting states are associated with lighting actions, wherein the lighting actions include turning lights on/off, setting light intensity levels, and creating lighting effects, and wherein the lighting effects include causing the lights to vary repeatedly between user defined intensity levels and causing a subset of the lights to repeatedly turn on/off in a predetermined marquee pattern.

7. The lighting sequence creation system of claim 6, wherein the light sequence definition graphical user interface includes a white board enabling both lighting actions and transitions between lighting actions to be defined.

8. The lighting sequence creation system of claim 7, wherein the transitions between lighting actions are defined to occur after expiration of user specified amounts of time.

9. The lighting sequence creation system of claim 7, wherein the transitions between lighting actions are defined to occur upon occurrence of user defined external input.

10. A display lighting system, comprising:

a light driver to set intensity levels of lights connected to a plurality of lighting channels; and a lighting controller configured to receive a compiled lighting sequence and use the compiled lighting sequence to provide input to the light driver to cause the light driver to set the intensity levels of the lights connected to the plurality of lighting channels according to the compiled lighting sequence, wherein the compiled lighting sequence comprises a plurality of lighting actions, and wherein transitions between lighting actions are defined in the compiled lighting sequence to occur after expiration of user specified amounts of time.

11. The display lighting system of claim 10, further comprising a lighting sequence creation system, the lighting sequence creation system including a graphical user interface configured to a enable lighting sequence to be specified, and a lighting sequence compiling system configured to compile the lighting sequence specified via the graphical user interface to create the compiled lighting sequence and forward the compiled lighting sequence to the lighting controller.

12. The display lighting system of claim 10, further comprising at least one sensor, and wherein input from the sensor is used by the lighting controller to at least partially control progression through the compiled lighting sequence.

13. The display lighting system of claim 10, wherein the compiled lighting sequence comprises a plurality of lighting actions, and wherein the transitions between lighting actions are defined in the compiled lighting sequence to occur upon receipt of user specified external input.

* * * * *